United States Patent [19]

Iraci

[11] Patent Number: 4,807,375

[45] Date of Patent: Feb. 28, 1989

[54] PLOWING DEVICE

[75] Inventor: Frank J. Iraci, Toms River, N.J.

[73] Assignee: Ark Welding Co., Inc., N.J.

[21] Appl. No.: 160,200

[22] Filed: Feb. 25, 1988

[51] Int. Cl.[4] ..... E01H 5/04

[52] U.S. Cl. ..... 37/236

[58] Field of Search ..... 37/234–236, 37/DIG. 19; 172/430, 2, 4, 45, 75, 810, 812, 828, 830, 831, 299; 414/699, 685

[56] References Cited

U.S. PATENT DOCUMENTS

| | | | |
|---|---|---|---|
| 3,585,319 | 6/1971 | Payerle | 37/234 |
| 3,967,175 | 6/1976 | Turley | 318/258 |
| 4,023,861 | 5/1977 | Schneld | 299/75 |
| 4,125,166 | 11/1978 | Bergius | 172/430 |
| 4,194,574 | 3/1980 | Benson et al. | 172/430 |
| 4,221,266 | 9/1980 | Fardal | 172/4 |
| 4,237,629 | 12/1980 | Schmidt | 37/234 |
| 4,353,177 | 9/1982 | Hoevstra | 37/234 |
| 4,554,751 | 11/1985 | Nicolosi et al. | 37/234 |
| 4,727,665 | 3/1988 | Verseef | 37/236 |

*Primary Examiner*—Eugene H. Eickholt
*Attorney, Agent, or Firm*—Eugene E. Renz, Jr.

[57] ABSTRACT

Adjustment device in a vehicle having a plow for plowing snow and the like so that when the vehicle is traveling in a forward direction the plow is moved between a raised position and a lowered position, and signal means for sending a signal indicating movement of the vehicle in a reverse direction. The improvement comprises control device for sensing the signal and activating the adjustment device to raise the plow to the raised position. The control device is further deactivated in the absence of the signal to lower the plow to the lowered position.

15 Claims, 1 Drawing Sheet

14
10
12
α
15

10
24
16
15
17
14
12

22
10
25
24
20
14
12
15

33
RAISE
NEUTRAL
LOWER
35
37
39
27
30
32
40
28
36
35
26
22
24
RIGHT Lα
CENTER
LEFT Lα
BATTERY SOLENOID
38
34
33
MOTOR SOLENOID
MOTOR
15
PUMP
SUMP 22
37
41
27
N.C. RELAY
TIMER
30
38
46
42
27
39
44
N.O. RELAY
40
45
26
28

PLOWING DEVICE

FIELD OF THE INVENTION

This invention relates to a device for automatically raising and lowering a plow which is attached to a vehicle and used for plowing snow and the like. The device is intended to lower the plow to a snow-engaging position when the vehicle is traveling in a forward direction and to raise the plow to an upper position when the vehicle is operated in reverse.

BACKGROUND OF THE INVENTION

In a typical vehicle, such as a four-wheel drive pick-up truck or the like which provided with a snow plow and is adapted to remove snow from roads, parking lots, driveways, and other surfaces, by pushing the snow, the plow is mounted to the front of the truck. The plow is mounted in conjunction with a means for raising and lowering the plow, such as by hydraulic pumps and the like so that the plow can be placed on the surface to be plowed and can be lifted from the surface when the plow is not in use.

Modern snow plows of this type contain a switch located in the cab of the truck to actuate the hydraulic pump and move the plow between a raised position and a lowered position. Oftentimes, there is a single switch which may be mounted on the dash, particularly in the case where the vehicle has an automatic transmission, or on the manual transmission shift lever when that form of transmission is in the truck, so that the operator can move the switch from a raising position to a lowering position as desired. In some cases, there is a middle or hold position for the switch. Depending upon the sophistication of the design, limit switches and springs may be used in conjunction with the control switch to limit or control the movement of the plow in an up or down direction. Additionally, switching means may be provided to shift the angle of attack of the plow to the left or right as desired.

Oftentimes, a truck with a snow plow will be used to clear large areas which have been covered with snow, such as shopping center and school parking lots, which are best cleared by pushing snow to one side of the lot or possibly to several sides in said large lots. These lots often have pylons or cement barriers to align parking spaces, but these objects make single pass snowplowing impossible. The best procedure for removing snow under these conditions involves repeated changing of direction as snow is pushed forward in drive or one of the forward gears, and the truck is backed up in reverse to approach a different area of snow covered pavement. As the lot becomes clear of snow, the need to change direction increases, particularly where the lot contains pylons and other barriers. This back and forth movement is best accomplished when the plow is raised during the reverse travel of the vehicle to avoid damaging the plow, followed by lowering the plow to again engage the snow in the next area being cleared. While this is not difficult over a short period of time, efficient operation of such a snow plowequipped truck requires the coordinated effort of two hands to do three tasks, namely, steer, shift, and adjust the plow height. If the plow is not raised when backing up oftentimes snow is redistributed over areas which have already been cleared. Additionally, the angle of the plow may be adjusted during this time calling for a fourth task at one time.

Owners of this kind of equipment are often independent operators, not having the massive snow plows that municipal and state government agencies employ. Operators of these plow-equipped trucks may work for as long as fifteen to eighteen hours at one time, or even longer. Independent operators need to make money when the opportunity exists, such as when a snowfall is fresh, and so speed of operation is important. Also important is the need to service as many customers as possible as soon as the snowfall has begun to subside. Naturally, fatigue, both physical and mental, begins to set in during this relatively difficult yet monotonous job. The ability to coordinate the steering wheel, the transmission shift lever and the plow switch becomes more difficult. The operation becomes slower or mistakes are made.

At the present time, there is no commercially available device which can be used to improve on the efficiency and reduce the fatigue of operating a truck fitted with a snow plow. While many manufacturers provide snow plows which are highly suitable for mounting on four-wheel drive vehicles, none of these manufacturers provide any equipment which can obviate the need to coordinate three tasks with two hands.

U.S. Pat. No. 2,824,849 describes a mechanical method for raising and lowering snow plows on motor vehicles. Such a design is extremely heavy duty and has been improved upon substantially by more modern designs. Larger equipment, such as that shown in U.S. Pat. No. 4,258,484 relates to grader-type snow plows used for clearing along highways. This design is most often not even capable of being used for parking lots and other areas which require maneuverability and the capability of back-and-forth operation.

In some construction equipment, such as rippers, as described in U.S. Pat. No. 4,031,964 sensitivity to an overload condition is described wherein lift cylinders are actuated to automatically raise a shank when an overload is applied to the shank during ripping operation. In that patent, a complicated design of electromagnetic valves and means for detecting overloads are employed.

Smaller plow products such as snow plows which are fitted to four-wheel drive vehicles are, as has been mentioned, readily available. Nevertheless, none of these designs resolve the problems noted above concerning the need for three functions being performed at one time, and no equipment is available to reduce fatigue or operator error due to fatigue.

SUMMARY OF THE INVENTION

It has now been discovered that substantial improvement in the operation of snow plows mounted on vehicles which are used by constantly shifting from drive or forward gear to reverse can be achieved for the present invention. Specifically, the present invention is admirably suited for vehicles which have a plow for engaging snow or the like when the vehicle is traveling in a forward direction. These vehicles must include a means for moving the plow between a raised position and a lowered position, such as by a switch means. In addition, the vehicles must be equipped with a signal means for sending a signal which indicates movement of the vehicle in a reverse direction or when the transmission has been shifted to reverse gear in anticipation of moving in reverse. The invention allows for a simple, economical modification of existing equipment to obtain the benefits of the invention.

The invention comprises the use of a detection means for detecting a signal indicating that the vehicle is in reverse gear and is beginning to move in a reverse direction. Typically, this detection means is operably connected to the back-up lights of the pick-up truck. When the gear selector is placed in reverse and the vehicle begins to travel in a reverse direction, current is passed through the wires leading to the back-up lights. The detection means senses the flow of current in these wires leading to the back-up lights. The detection means is activated by this signal, such as the current flowing in the back-up light wire, and when the detection means is activated, it disengages the means for moving the plow to a lowered position. Simultaneously, it engages the means which are provided to raise the plow to a raised position. The motor or pump which drives the hydraulic fluid operating the raising and lowering feature of the snow plow is activated to respond to the presence or absence of current flowing to the back-up light. Thus, when the reverse gear is disengaged, the plow will be returned to the lowered position for engaging snow without the need for the driver to perform a separate step.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 2:
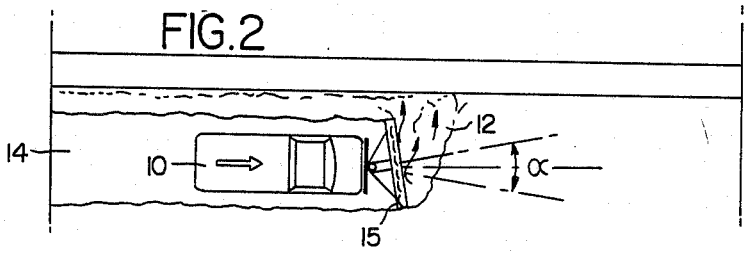
FIG. 2 is a top view of the vehicle shown in FIG. 1.
Figure 1:
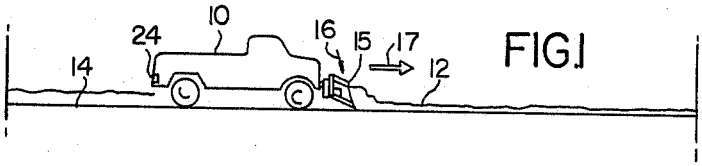
FIG. 1 is a side pictorial view of a vehicle operating with a snow plow in an environment where the present invention is to be employed.
Figure 3:
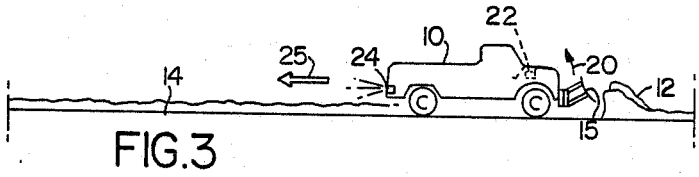
FIG. 3 is a pictorial view of the vehicle of FIG. 1 operating in the reverse direction with the snow plow in a raised position.

As shown in FIGS. 1, 2, and 3, a truck 10 is employed to plow snow 12 such as on a street 14 or in a parking lot, driveway or other surface. The plow 15 is lowered in the direction of arrow 16 as the truck moves forward in direction 17 and scrapes snow from the surface of the pavement. In some snow plow designs, the angle of the plow 15 with respect to the forward direction 17 can be adjusted, as shown in FIG. 2, by an angle $\alpha$ so that snow is directed to the side, allowing for a longer forward pass during plowing. At the end of the forward movement of the truck 10, the plow 15 is raised in the direction of arrow 20 and the truck reverses direction. In accordance with the present invention, control box 22 senses a signal, such as from back-up light 24 when the truck 10 is moving in the reverse direction shown by arrow 25. As will be explained hereinafter, the control box 22 operates to raise the plow 15 in the direction shown by arrow 20 when it is sensing a signal from back-up light 24, indicating the intention of the operator to move in the direction of arrow 25. When the gear selector is placed in the forward direction, the control box no longer senses current in the back-up light 24, and the plow 15 is lowered in the direction of arrow 16 to pavement-contacting position for operation in the forward direction to plow snow.

Figure 4:
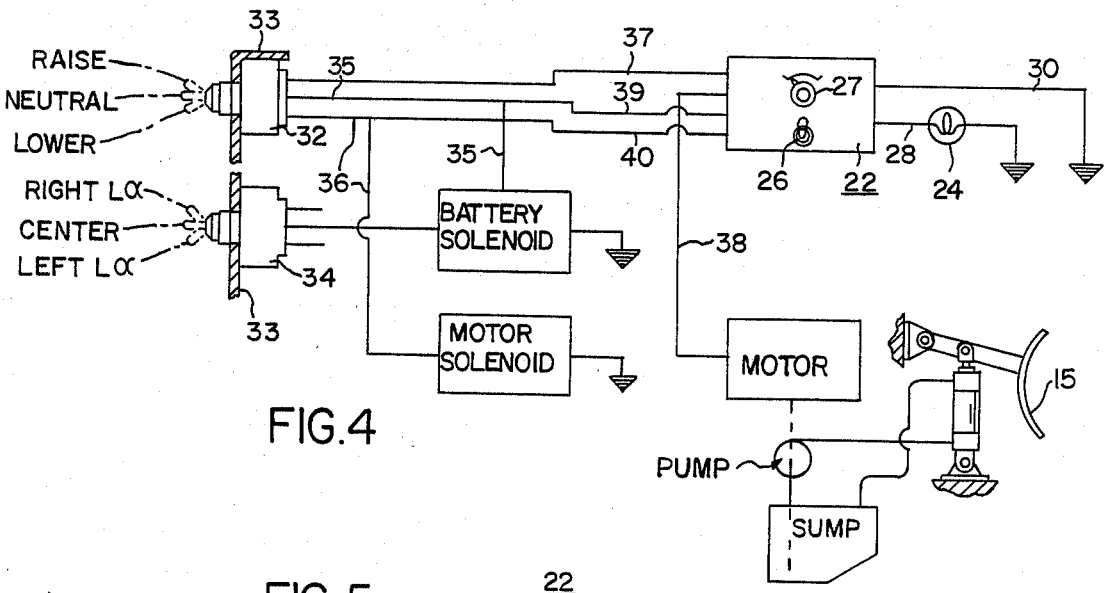
FIG. 4 is a schematic view of a conventional wiring harness for controlling the position of a snow plow mounted on a vehicle, with the device of this invention incorporated therein.

As shown in FIG. 4, the control unit 22 has an on/off switch 26 and a timer control 27. The unit 22 is connected to the back-up light 24, by wire 28, and is connected to ground via wire 30. As will be described hereinafter, the unit 22 senses flow of current in the back-up light 24 via wire 28 when the unit is on.

As has been previously stated, most plows which are attached to trucks for snow plowing purposes include a means for moving the plow between a raised position and a lowered position. Meyers Products Inc. produces a line of MEYER ® snow plows which are admirably suited for use with the present invention. Particular models which have been used in conjunction with the present invention are the E-47 and E-47H MEYER ELECTRO-TOUCH ™ snow plows. These snow plows are hydraulically operated and include in-cab switches to control the position of the snow plow both in an up and down, and angled position.

Referring again to FIG. 4, the switch 32 is mounted via bracket 33 to the inside of the cab of a truck which has been fitted with a plow of the type described. This switch 32 is normally operable to direct the plow to be raised when the switch is raised and to be lowered to a ground engaging position when the switch is lowered. The switch also has a neutral position. In some models, a spring device is employed within the switch so that the switch will automatically return to the center or neutral position when it is no longer being held in the raised position by the operator. Typically, these switches do not include a spring return of the switch to the center position from the lowered position. As has been previously mentioned, the angle of the plow may be adjusted by an embodiment controlled by switch 34. Typically, switch 34 will have a spring return to the center from both positions.

In order to connect the control unit 22 of the present invention to the standard switch 32 of a conventional snow plow 15, the following connections are made. The switch 32 contains a wire 35 which is connected to the battery solenoid and a wire 36 which is connected to the motor solenoid. Also, attached to the switch 32 is a wire 37 which normally would be connected to the hydraulic system. Wire 37 is spliced into control box 22 and a return line 38 comes out of the box and is connected to the motor so that the hydraulic system operates to adjust the level of the plow. Wire 35 connected to the battery solenoid is also connected by wire 39 to the control unit 22, and, in the same manner, wire 36 to the motor solenoid is connected to the control unit 22 via wire 40.

Figure 5:
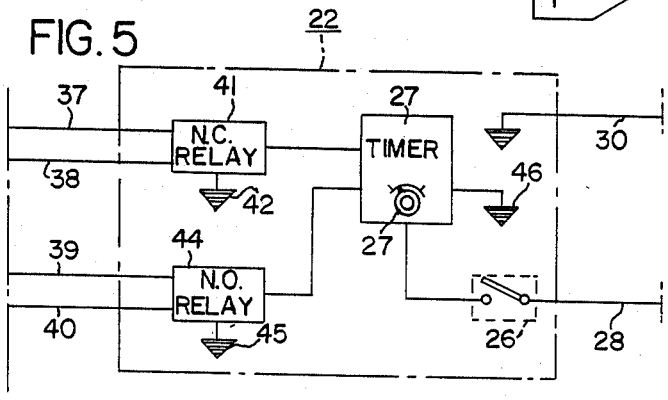
FIG. 5 is a detailed schematic of the control unit of the device of the present invention shown in FIG. 4.

As shown in FIG. 5, a signal enters the control unit 22 via wire 28 indicating the presence of current in the back-up light 24. Wire 30 assures that the unit is grounded. As current enters the control unit 22, a simple on/off switch 26 determines the operation of the control unit. When the device is in operation and the back-up light wire 28 indicates that the vehicle is operating in reverse, the switch, when it is on, allows current to flow to the timer 27. The timer has a control which allows it to be adjusted from, for example, about 0 to about 4 seconds with a 2.5 second time being a practical setting for most applications of the present invention. Activation of this timer activates relay 41, which is grounded at 42 and which is normally closed.

The timer 27 also allows flow of current to relay 44, which is grounded at 45 and which is in a normally open condition. The timer is also grounded at 46.

Accordingly, when current flows through the back-up wire 28 through switch 26, timer 27 is activated for a period of time, for example, 2.5 seconds. Normally open relay 44 is closed during this time sequence by flow of current through the switch 26, so that current flows in lines 39 and 40. Simultaneously, normally closed relay 41 is opened by flow of current through switch 26, stopping flow of current through wires 37 and 38. In this circumstance, the solenoids attached to the hydraulic system which raises and lowers the plow are instructed to raise the plow, which raising occurs for the duration of the time set on the timer switch. The solenoid members which control the raising and lowering of the plow receive the same signal that would be received if the switch is in the up or raised position.

Once the operator has traveled the desired distance in reverse, the transmission selector is placed in drive and current no longer flows through wire 28 from the back-up light. As current no longer passes through the switch 26, relay 41, which is normally closed except when receiving current, again closes and the system returns to the normal position where the switch 32 instructs the plow motor mechanism to lower the plow.

In the event that switch 26 is turned off, the system operates as though the control unit 22 were not in the circuit. Flow of current through the back-up light wire 28 does not pass switch 26, does not activate timer 27 and does not affect either relay 41 or 44.

Because the control unit 22 is designed to operate only when the master control switch 32 is in the down position, the snow plow will automatically be in a down position when the vehicle is in a forward operating mode. Placing the vehicle in the reverse gear thereby activating current in the back-up light wire 28, causes the device to operate as described above and raise the plow. When the plow control switch 32 is in the neutral or center position, the system to adjust the level of the plow is not operating and the control unit will have no affect. Similarly, when switch 32 is activated to raise the plow, the switching circuitry is identical to that when the device is in operation. Specifically, movement of switch 32 to the raising or upper position takes the control unit 22 out of the circuit and causes the plow to be raised in the normal manner.

In summary, when the unit is switched off, the operator can raise and lower the plow in the manner intended by the manufacturer using the switch 32, which is mounted on the dash of the vehicle. If switch 26 is turned on, putting the system into use, the control unit is still dependent on the position of switch 32. When switch 32 is in the center or neutral position, the control unit 22 does not function. When the switch 32 is in the raised position causing the plow to be raised, the control unit 22 does not function. When the switch 32 is in the lowered position and switch 26 is in the on position, one of two events can take place. When the truck is in drive, or in one of the forward gears if it is a manual transmission, the plow is in the lowered position as determined by switch 32. When the transmission is shifted to a reverse gear, causing current to flow in wire 28 from the back-up light 24, timer 27 causes relay 44 to close and relay 41 to open, thereby raising the plow automatically. Because of the timed limit on timer 27, this raising of the plow only occurs for a predetermined period of time, allowing for the plow to achieve a satisfactory raised position. Then, when the drive disengages the reverse gear, thereby shutting off current in wire 28, the normal operating condition of the switch 32 in the down position returns the plow to a snow engaging position on the pavement. The angle $\alpha$ can be adjusted at any time during this operation as before.

As can be appreciated, the control unit 22 raises and lowers the plow as the driver selects forward and reverse gears, allowing the operator to have one hand on the steering wheel and one hand on the gear selector to rapidly and efficiently clear snow from the pavement, parking lot other surfaces. Fatigue is substantially reduced as the need to constantly adjust the position of the plow is taken care of automatically. The elimination of the raising and lowering of the plow relieves a physical step but much more importantly, eliminates a judgment step which is affected by both mental and physical fatigue. Operation of the snow plow is substantially more efficient and certainly much safer.

All the foregoing has been described as being activated by the flow of current in a back-up light, the source of signal could be tied to the back-up warning beeper that some commercial vehicles now employ or to any other source of electrical current indicating that the vehicle is not operating in a forward direction.

While particular embodiments of the present invention have been illustrated and described herein, it is not intended to limit the invention and changes and modifications may be made therein within the scope of the following claims.

What is claimed is:

1. In a vehicle having a plow for plowing snow and the like when said vehicle is traveling in a forward direction, including adjustment means for moving said plow to a raised position and signal means for sending a signal indicting a change in movement of said vehicle, the improvement comprising:

control means for sensing said signal and activating said adjustment means to raise said plow, said control means further being deactivated in the absence of said signal.

2. The device of claim 1, wherein said adjustment means includes means for moving said plow between a raised position and a lowered position, said control means activating said adjustment means to raise said plow to said raised position.

3. The device of claim 2, wherein said adjustment means is selectively adapted to move said plow to said lowered position in the absence of said signal.

4. The device of claim 1, wherein said signal means is activated by movement of said vehicle in the reverse direction.

5. The device of claim 4, wherein said vehicle includes a back-up light, said back-up light providing said signal for said signal means.

6. The device of claim 1, wherein said control means further includes timer means for controlling the operation of said adjustment means.

7. The device of claim 6, wherein said timer means is adjustable over a range of about 0 to about 4 seconds.

8. The device of claim 7, wherein said timer means is set for a period of about 2.5 seconds.

9. In a vehicle having a plow for plowing snow and the like when said vehicle is traveling in a forward direction, including adjustment means for moving said plow between a raised position and a lowered position, and signal means for sending a signal indicting movement of said vehicle in a reverse direction, the improvement comprising control means for sensing said signal and activating said adjustment means to raise said plow to said raised position,said control means further being deactivated in the absence of said signal to lower said plow to said lowered position.

10. The device of claim 9, wherein said vehicle includes a back-up light, said back-up light providing said signal to said signal means.

11. The device of claim 9, wherein said control means further includes timer means for controlling the operation of said adjustment means.

12. The device of claim 11, wherein said timer means is adjustable over a range of about 0 to about 4 seconds.

13. The device of claim 12, wherein said timer means is operable for about 2.5 seconds.

14. In a vehicle having a plow for plowing snow and the like when said vehicle is traveling in a forward direction, including adjustment means for moving said plow between a raised position and a lowered position, and signal means including back-up lights for sending a signal indicting movement of the vehicle in the reverse direction, the improvement comprising:

control means for sensing said back-up light signal and activating said adjustment means to raise said plow to said raised position when receiving said back-up light signal, said control means further being deactivated to move said plow to said lowered position in the absence of a back-up light signal, said control means further including timer means for controling the operation of said adjustment means over a range of about 0 to about 4 seconds.

15. The device of claim 14, wherein said timer means is adjusted to operate over a period of about 2.5 seconds.

* * * * *